United States Patent [19]

Luker et al.

[11] Patent Number: 4,572,387

[45] Date of Patent: Feb. 25, 1986

[54] SCREW-TYPE SAFETY CAP

[75] Inventors: Edward Luker; David M. Wright, both of Evansville, Ind.

[73] Assignee: Sunbeam Plastics Corporation, Evansville, Ind.

[21] Appl. No.: 707,205

[22] Filed: Mar. 1, 1985

[51] Int. Cl.[4] ..... B65D 41/34

[52] U.S. Cl. ..... 215/252

[58] Field of Search ..... 215/252

[56] References Cited

U.S. PATENT DOCUMENTS 4,352,436 10/1982 Chartier et al. ..... 215/252

4,448,318 5/1984 Lowe ..... 215/252

*Primary Examiner*—Donald F. Norton

*Attorney, Agent, or Firm*—Fisher, Crampton, Groh & McGuire

[57] ABSTRACT

A threaded closure having both a tamper indicating and a non-backoff feature which locks the closure to a container to avoid unwanted loosening. The closure takes the form of a one piece cylindrical cap with an inwardly directed bead at its open end. The cap bead engages a complimentary bead on the neck of the container as the cap is screwed onto the container, and the cap bead snaps over the container bead to form a non-backoff seal. The cap has a tamper indicating band attached to its lower end by frangible webs. The band and container have complimentary stop means which coact to restrain movement of the band when the cap is unthreaded, fracturing the frangible webs giving an indication of tampering or initial opening.

23 Claims, 9 Drawing Figures

SCREW-TYPE SAFETY CAP

This invention relates to safety closures, and more particularly, to a tamper indicating closure which indicates to the observer that the container-closure package has not been opened or that it has been opened or been tampered.

There are a wide variety of safety closures which indicate to a perspective purchaser by the condition of the package whether or not it has been opened or tampered. One of the most important criteria in designing such a closure, is to provide one that can be applied to the container without destroying the indicia intended to act as the tamper indicator. This is particularly true where the tamper indicator is a ring or band attached to a cap by frangible bridges or webs, and high speed packaging equipment is used.

When the closure is of the screw-type, the tamper indication is usually activated when an unscrewing or unthreading torque is applied to open the package. Where frangible webs are used, the opening torque is designed to cause fracture or breaking of the frangible webs. It is, therefore, a paramount concern to prevent web breakage when a torque of similar magnitude is used to apply or thread the closure onto the container.

With screw-type fastening, it is often desirable to provide a non-backoff freature which prevents accidental and undesirable unthreading of the closure from the container and that will retain the package seal even if the closure is partially unthreaded. Combining such a non-backoff feature with a tamper indicating feature further complicates the design since the non-backoff feature usually requires additional threading or tightening torque which increases the danger of fracturing the frangible webs during the initial tightening process.

It is, therefore, an object of this invention to provide a screw-type safety closure having tamper indicating means.

It is another object of this invention to provide a screw-type closure having a non-backoff feature to prevent accidental unsealing of the closure from the container.

It is a further object of this invention to provide a screw-type safety closure combining a tamper indicating means with a non-backoff feature which functions after the initial opening of the package and the function of the tamper indicating means has been fulfilled.

The objects of this invention are accomplished by a single piece closure taking the form of a threaded cap having a flat top and a first cylindrical skirt portion which extends from the top and has internal threads which are complimentary to the container threads. A second cylindrical skirt portion has a larger diameter than the first threaded skirt portion and extends downwardly therefrom terminating in an inwardly projecting bead or flange at its free end. This skirt bead cooperates with a compimentary bead on the container below the threads to form a non-backoff snap lock. A cylindrical tamper indicating band is spaced from the bottom of the second cylindrical skirt portion and is connected to it by a plurality of circmferentially spaced axially extending frangible connecting webs so that the spaces between the webs define slot areas. The tamper indicating band is a larger diameter than the second cylindrical skirt portion from which is depends and it has stop means located at its lower end which is one embodiment takes the form of a second inwardly projecting bead which cooperates with a second bead beneath the first bead on the container to form a friction generating surface and a snap lock for the container and closure package in its original, as filled, condition. In this embodiment, the bottom of the second cylindrical skirt has a planar driving surface which cooperates with a parallel planar surface on the top of the tamper indicating band. In one embodiment the planar surface on the top of the tamper indicating band is formed by a plurality of axially extending projections with flat tops forming a drive platform extending into the slot areas between each connecting web. These drive platforms could be formed on the bottom of the second cylindrical skirt portion to cooperate with a planar surface on the top of the tamper indicating band.

When the cap is assembled to the container, the tamper indicating band passes over the container threads and the first container bead without interference, and as the cap is screwed onto the container, the engagement of the skirt bead with the container bead swells or pushes out the second cylindrical skirt portion to align the driving platforms on one member with the planar driving surface on the other member. At the same time, the stop member or bead at the bottom of the tamper indicating band engages the stop or lower bead on the container to provide frictional resistance which moves the planar driving surfaces into engagement with each other collapsing the webs and providing axial movement of the bands without relative rotational movement which would tend to shear the webs. The tightening process is complete when the non-backoff bead at the end of the second cylindrical skirt portion snaps over the bead on the container and the stop bead on the tamper indicating band snaps over the lower bead on the container.

When the cap is unthreaded from the container, the band and container stop beads or flanges cooperate to prevent relative axial movement therebetween, and since the planar driving surfaces are disengaged from each other, the frangible webs are fractured which leaves the tamper indicating band on the container after the cap has been removed.

In a second embodiment, the stop means on the tamper indicating band takes the form of a plurality of equally spaced ratchet teeth which extend around the periphery of the band which cooperates with the stop means on the container which includes a plurality of ratchet teeth on the container. In the tightening process the cammed or sloped surface of the cooperating ratchet teeth on the band and the container allow contact with each other without fracture of the frangible webs. When the band is unthreaded from the container, the flat stop surfaces of the ratchet teeth on the band and container cooperate to prevent relative rotation causing fracture of the frangible webs as in the first embodiment.

The preferred embodiments of the invention are illustrated in the drawing in which.

Figure 1:
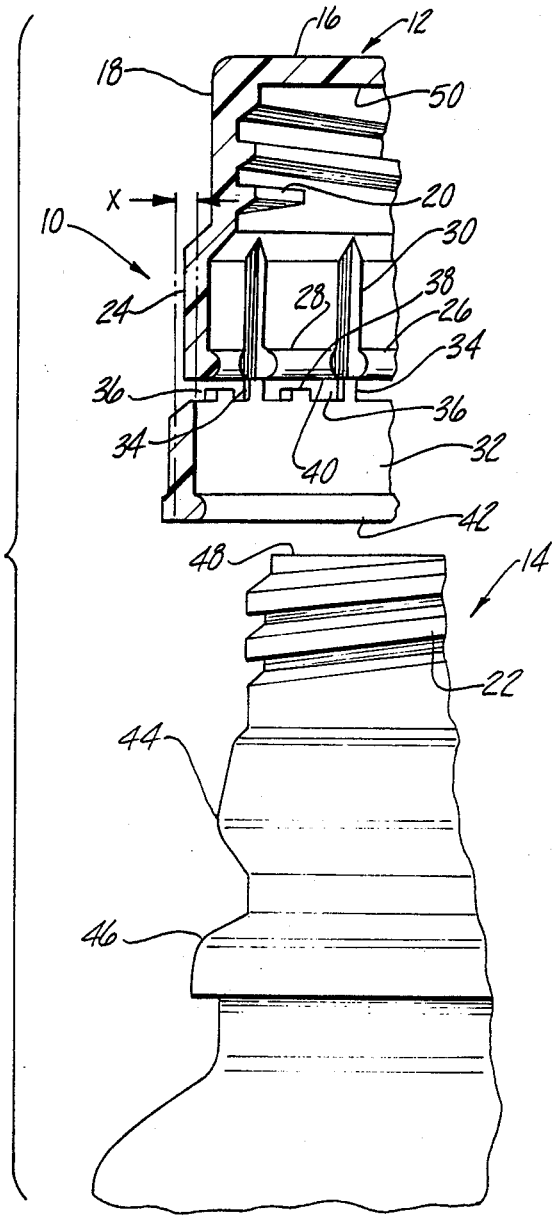
FIG. 1 is a fragmentary perspective view of the closure and the container to which the closure is applied embodying the present invention.
Figure 2:
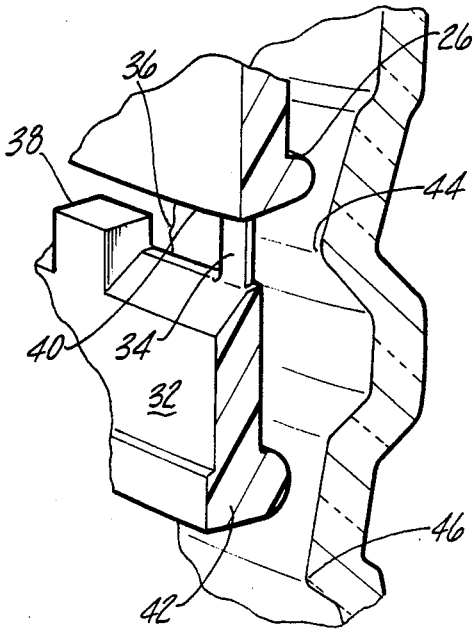
FIG. 2 is a fragmentary perspective view in section showing the cap applied over the container neck as the cap beads begin to make contact with the container beads.
Figure 3:
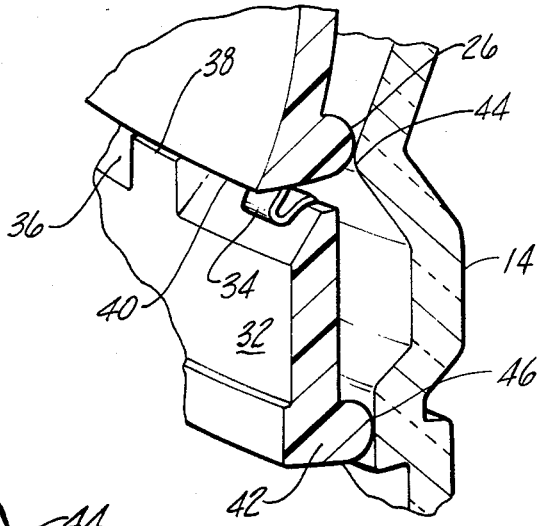
FIG. 3 is a partial perspective view similar to FIG. 2 showing the cap skirt bead and the tamper indicating band bead in contact with the container beads as the second cylindrical skirt portion is pushed outward aligning the skirt with planar driving platforms.
Figure 4:
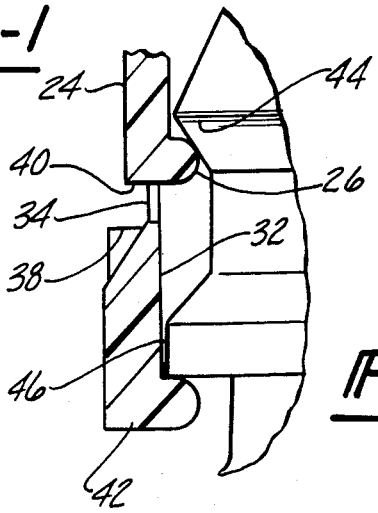
FIG. 4 is a partial side elevation in cross section showing the skirt bead and band bead in full engagement with the container beads.

Referring to FIGS. 1 through 4, closure 10 is shown as a one piece screw-cap 12 designed for application to threaded container 14. Screw-cap 12 is cup shaped having a flat top 16 and first cylindrical skirt portion 18 having internal threads 20 for engagement with complimentary container threads 22. Cap 12 flares out from the first cylindrical skirt portion 18 to a second cylindrical skirt portion 24 having an inwardly projecting bead 26 which is segmented or divided into a plurality of segment sections 28 to accommodate therebetween recessed unscrewing teeth 30 used in the molding process and connecting webs 34. Spaced from the bottom of the second cylindrical skirt portion 24 is tamper indicating band 32 formed integrally as part of the cap and joined to the second skirt portion by frangible connecting webs 34, the spaces between the adjacent webs 34 defining slot areas 36. Band 32 has a larger diameter than the second skirt portion 24, being offset outwardly as shown by the dimension X in FIG. 1. Planar drive platforms 38 are formed on the top of tamper indicating band 32 by upwardly extending axial projections in slot areas 36. These drive platforms 38 engage the flat planar surface 40 at the bottom of second skirt portion 24 in the assembly process, planar platforms 38 being parallel to planar surface 40. The band 32 has inwardly projecting bead 42 at its lower end. Container 14 has upper outwardly projecting bead 44 and lower outwardly projecting bead 46 which engage and coact with skirt bead 26 and band bead 42, respectively. As screw-cap 12 is assembled to container 14, tamper indicating band 32 passes over container threads 22 and the upper container bead 44 without interference. As cap 12 is screwed onto container 14, cap threads 20 engaging container threads 22, skirt bead 26 engages the upper container bead 44 to swell or push outwardly the second cylindrical skirt portion 24 so as to align the planar drive surface 40 at the bottom of skirt 24 with drive platforms 38 on the top of tamper indicating band 32 as shown in FIGS. 2 and 3. At the same time, band bead 42 engages the lower container bead 46 providing frictional resistance which moves the planar driving platforms 38 into engagement with planar driving surface 40 which collapses webs 34 into the open slot areas 36 as best seen in FIG. 3. Thereafter, the threading, clockwise rotation of cap 12 will be transmitted to band 32 without relative rotational movement between cap 12 or lower skirt portion 34 and band 32. As the skirt bead 26 passes over upper container bead 34, it will snap onto the container to provide a non-backoff coacting seal between the two beads as shown in FIG. 4. At the same time, or at substantially the same time, the skirt bead 42 will snap over lower container bead 46 likewise forming a coacting seal. The non-backoff coaction between skirt bead 26 and upper container bead 44 will maintain a tight seal with the upper surface 48 of container 14 seating against the inside surface 50 of flat cap top 16. This seal will be retained during the initial rotation of cap 12 in an unthreading, counterclockwise direction.

As shown in FIG. 4 in its initial, as filled, sealed position, skirt bead 26 is snapped over upper container bead 44 forming a non-backoff seal, and tamper indicating band bead 42 is snapped over lower container bead 46 forming a tamper resistant connection. Frangible webs 34 straighten out from the folded position shown in FIG. 3 to the vertical position shown in FIG. 4. When the cap 12 is unthreaded from the container 14, the coaction of band bead 42 with container bead 46 resists upward movement of band 32 while the planar driving surfaces 38 and 40 are disengaged causing fracture of the frangible webs 34 leaving the tamper indicating band 32 on the container as the cap is removed. While the drive platforms 38 are shown as extending upwardly from tamper indicating band 32 to engage the flat planar surface 40 at the bottom of cap skirt 24, the drive surfaces could extend downwardly from the second cap skirt portion 24 to engage a flat planar surface on the top of band 32.

Figure 5:
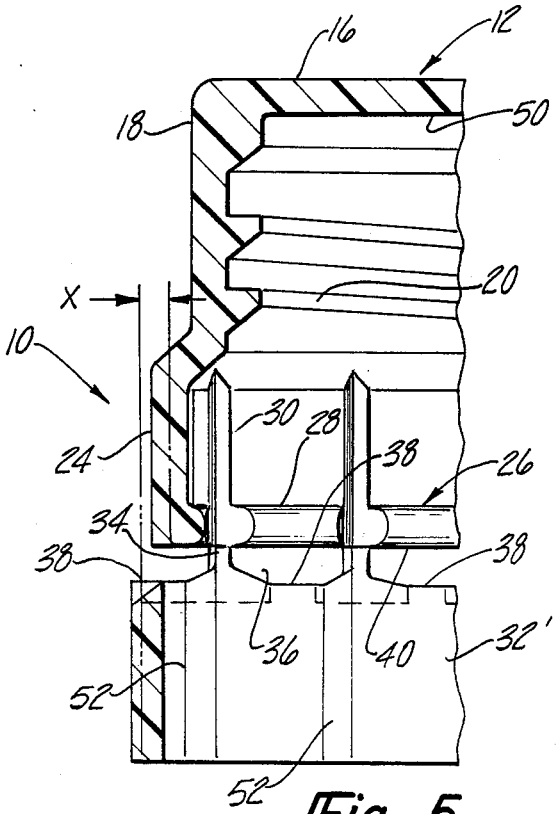
FIG. 5 is a fragmentary perspective view in section showing another embodiment of the invention.
Figure 6:
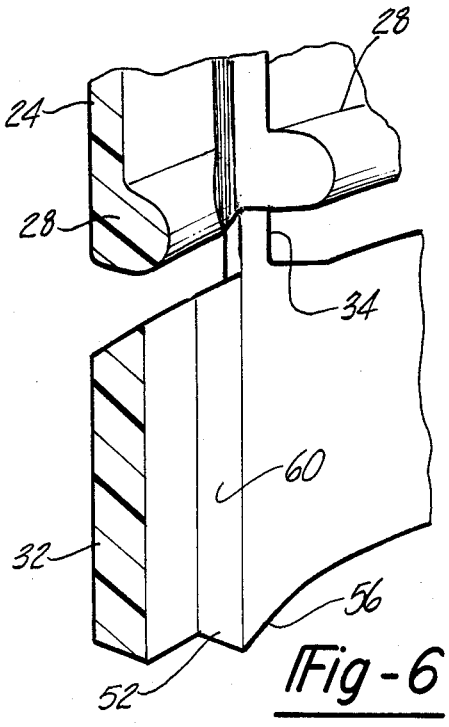
FIG. 6 is an enlarged fragmentary perspective view in section showing the alignment of the inner web surface with the inner cap skirt surface and the inner tamper indicating band surface.
Figure 7:
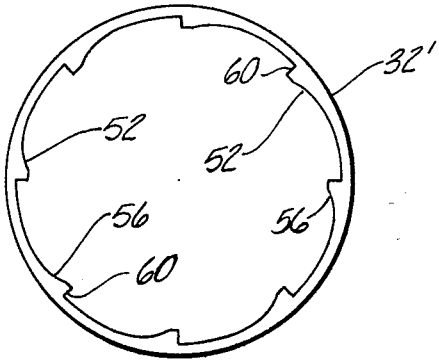
FIG. 7 is a top plan view of the tamper indicating band of FIG. 5 showing the details of the ratchet teeth.
Figure 8:
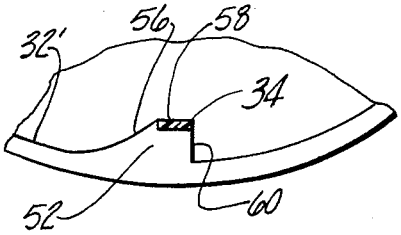
FIG. 8 is an enlarged view showing the details of one of the teeth shown in FIG. 7.
Figure 9:
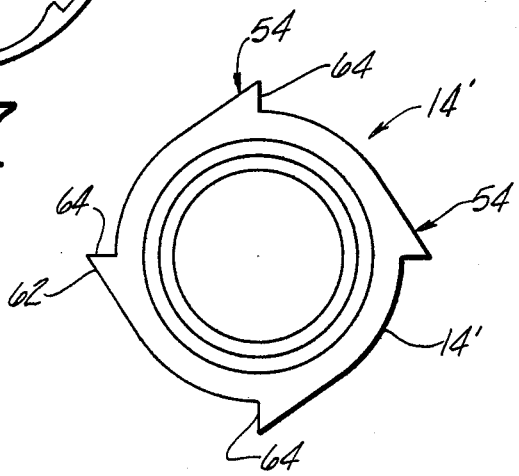
FIG. 9 is a top view of the container to which the closure of FIG. 5 is applied showing the details of the ratchet teeth.

In the embodiment shown in FIGS. 5–9 a different stop is used on tamper indicating band 32′ to ensure fracture of the frangible webs upon initial unthreading of the cap. That is, the coacting flanges of FIGS. 1–4 have been replaced by a ratchet mechanism. FIG. 5 shows the screw-cap 12 without the container 14. Screw-cap 12 is formed in the same manner as shown in FIG. 1 with a first cylindrical skirt portion 18, a second cylindrical skirt portion 24, and a depending tamper indicating band 32 connected by frangible webs 34 and offset from the second cylindrical portion 24 by a radial distance X. Inwardly extending ratchet teeth 52 are formed on the inside diameter of band 32′. There are four similarly formed ratchet teeth 54 formed on the container 14′ as shown in FIG. 9. Each ratchet tooth 52 has a cam surface 56 which slopes inwardly from the inner surface 58 of tooth 52 to the inner wall of band 32′, and each tooth has a radially extending stop surface 60. Container ratchet teeth 54 have similar coacting ramp surfaces 62 and radial stop surfaces 64. The inner walls of frangible webs 34 are formed flush with inner wall of second skirt portion 24, and webs form the flat inner surfaces 58 of ratchet teeth 52 as shown in FIGS. 6 and 8.

When the screw-cap 12 of FIG. 5 is assembled to a container 14, the tamper indicating band 32′ passes over the container threads and the container upper bead without interference, and the second skirt portion passes over the container threads without interference. As the cap threads engage the container threads, the ratchet teeth 52 on the band 32′ engage ratchet teeth 54 on the container 14′. That is, the sloping cam surface 56 on band teeth 52 slide over the ramp surface 62 on the container teeth 54. This smooth gradual contact of cam surfaces 56 with ramp surfaces 62 generates very little friction so that the planar driving surfaces are not necessary. The webs will remain in their normal axial position during assembly. When the cap 12 is unthreaded from the container 14′ the ratchet teeth 52 on the band 32′ will engage the ratchet teeth 54 on the container 14′. Specifically four of the flat stop surfaces 60 on band teeth 52 will engage corresponding flat stop surfaces 64 on four container ratchet teeth 54 so that the band cannot be rotated. This will cause fracture of the frangible webs 34 as the cap 12 is unscrewed.

In both embodiments of the invention, the tamper indicating band is severed from the main body of the cap to indicate that the initial sealing of the container has been broken or tampered with. The non-backoff feature of the cap will continue to function after the initial opening of the container.

We claim:

1. A screw-type safety cap for use on a container having a threaded neck, and outwardly projecting bead below said thread and stop means below said bead, said cap comprising, in combination:

a flat top;

a first cylindrical skirt portion depending from said top having internal threads complimentary to said container threads;

a second cylindrical skirt portion having a larger diameter than said first cylindrical skirt portion and depending therefrom with an inwardly projected bead at its free end;

a tamper indicating band spaced from the bottom of said second cylindrical skirt portion and connected thereto by a plurality of circumferentially spaced axially extending frangible webs, said band having stop means cooperating with the stop means on said container;

whereby as said cap is assembled to a container, said band and container stop means contact each other without fracture of said webs snapping said skirt bead over said container bead;

and when said cap is unthreaded from said container, said band and container stop means cooperate to resist relative movement therebetween causing fracture of said frangible webs leaving said tamper indicating band on said container after said cap has been removed.

2. The screw-type safety cap according to claim 1 wherein said stop means includes an inwardly projecting bead at the free end of the tamper indicating band which cooperates with stop means on said container which includes a second outwardly projecting bead.

3. The screw-type safety cap according to claim 2 wherein the diameter of said tamper indicating band is larger than the diameter of said second cylindrical skirt portion.

4. A screw-type safety cap according to claim 1 wherein stop means includes a plurality of inwardly projecting ratchet teeth extending around the inner periphery of said band which cooperate with the stop means on said container which includes a plurality of ratchet teeth on said container.

5. The screw-type safety cap according to claim 4 wherein the diameter of said tamper indicating band is larger than the diameter of said second cylindrical skirt portion.

6. A screw-type safety cap for use on a container having a threaded neck, and outwardly projecting bead below said threads and stop means below said bead, said cap comprising, in combination:

a flat top;

a first cylindrical skirt portion depending from said top having internal threads complimentary to said container threads;

a second cylindrical skirt portion having a larger diameter than said first cylindrical skirt portion and depending therefrom with an inwardly projecting bead at its free end;

a tamper indicating band spaced from the bottom of said second cylindrical skirt portion and connected thereto by a plurality of circumferentially spaced axially extending frangible connecting webs, with spaces between adjacent webs defining slot areas, said band having a diameter larger than the diameter of second cylindrical skirt portion and having stop means cooperating with the stop means on said container;

the bottom of said second cylindrical skirt portion and top of said tamper indicating band having parallel planar driving surfaces;

whereby as said cap is assembled to a container, the tamper indicating band passes over the container threads and the container bead without interference and, as the cap is screwed onto the container, the engagement of the skirt bead with the container bead swells the second cylindrical skirt portion to align said planar driving surfaces and at the same time the band stop means engages the container stop means providing frictional resistance which moves the planar driving surface into engagement collapsing said web and providing axial movement of said band without relative rotational movement between said band and said second cylindrical skirt portion while snapping said skirt bead over said container bead;

and when said cap is unthreaded from said container, said band and container stop means cooperate to prevent relative rotation therebetween while said planar driving surfaces are disengaged causing fracture of said frangible webs leaving said tamper indicating band on said container after said cap has been removed.

7. The screw-type safety cap according to claim 6 wherein stop means includes an inwardly projecting bead at the free end of said tamper indicating band which cooperates with stop means on said container which includes a second outwardly projecting bead.

8. The screw-type safety cap according to claim 6 wherein said stop means includes a plurality of inwardly projecting ratchet teeth extending around the inner periphery of said band which cooperates with stop means on said container which includes a plurality of ratchet teeth on said container.

9. The screw-type safety cap according to claim 7 wherein the planar driving surface on one of said bottom of said second cylindrical skirt portion and the top of said tamper indicating band includes a plurality of drive platforms axially extending into said alot areas with diametric planar ends to engage the other said parallel driving surface.

10. The screw-type safety cap according to claim 9 wherein said drive platforms are located on the top of said tamper indicating band extending axially upward with diametric planar ends which engage the planar driving surface on the bottom of said second cylindrical skirt portion.

11. The screw-type safety cap according to claim 10 wherein the plurality of platforms comprises eight equally spaced platforms extending around the periphery of said tamper indicating band.

12. The screw-type safety cap according to claim 11 in which the plurality of circumferentially spaced axially extending frangible connecting webs include eight webs with said drive platforms being individually located in the slot areas between said webs.

13. The screw-type safety cap according to claim 6 wherein said skirt bead includes a plurality of equally spaced bead segments extending around the periphery of said second cylindrical skirt portion.

14. The screw-type safety cap according to claim 13 wherein said frangible connecting webs are located in each of the spaces between said bead segments.

15. The screw-type safety cap according to claim 14 wherein the inner surface of said webs are aligned with the inner surface of said tamper indicating band.

16. The screw-type safety cap according to claim 14 further including axial extending recessed teeth in the inner surface of said second cylindrical skirt portion adjacent said connecting webs, both being located in the spaces between bead segments.

17. The screw-type safety cap for use on a container having a threaded neck and spaced upper and lower outwardly projecting beads below said threads, said cap comprising, in combination:

a flat top;

a first cylindrical skirt portion depending from said top and having internal threads complimentary to said container threads;

a second cylindrical skirt portion having a larger diameter than said first cylindrical skirt portion and depending therefrom with an inwardly projecting bead at its free end;

a tamper indicating band spaced from the bottom of said second cylindrical skirt portion and connected thereto by a plurality of circumferentially spaced axially extending frangible connecting webs, the space between adjacent webs defining open slot area, said band having a diameter larger than the diameter of said second cylindrical skirt portion and having an inwardly projecting bead at its free end;

the bottom of said second cylindrical skirt portion and the top of said tamper indicating band having parallel planar driving surfaces;

whereby, as said cap is assembled to a container, the tamper indicating band passes over the container threads and upper container bead without interference, and, as the cap is screwed onto the container, the engagement of the skirt bead with the upper container bead swells the second cylindrical skirt portion to align said planar driving surfaces and at the same time the band bead engages the lower container bead providing frictional resistance which moves the planar driving surfaces into engagement collapsing said webs and providing axial movement of said band without relative rotational movement between said band and said second cylindrical skirt portion to snap said band bead over said lower container bead while snapping said skirt bead over said upper container bead;

and when said cap is unthreaded from said container, the engagement of the band bead with the lower container bead resists relative axial movement therebetween, and, as the planar driving surfaces are disengaged, fracture of said frangible webs is caused leaving said tamper indicating band on said container after said cap has been removed.

18. The screw-type safety cap according to claim 17 wherein said skirt bead includes a plurality of spaced apart segments extending around the periphery of said second cylindrical skirt portion with said webs occupying the spaces between adjacent segments.

19. The screw-type safety cap according to claim 18 wherein said skirt bead comprises eight equally spaced segments having eight equally spaced webs in the spaces between each segment.

20. The screw-type safety cap for use on a container having a threaded neck and outwardly projecting bead below said threads and a plurality of equally spaced ratchet teeth extending around the neck below said bead, said cap comprising, in combination:

a flat top;

a first cylindrical skirt portion depending from said top having internal threads complimentary to said container threads;

a second cylindrical skirt portion having a larger diameter than said first cylindrical skirt portion and depending therefrom with an inwardly projecting bead at its free end;

a tamper indicating band spaced from the bottom of said second cylindrical skirt portion and connected thereto by a plurality of circumferentially spaced axially extending frangible webs, said band having a diameter larger than the diameter of said second cylindrical skirt portion and having a plurality of inwardly projecting ratchet teeth extending around the inner periphery of said band adapted to coact with the ratchet teeth on said container;

whereby as said cap is assembled to the container and tamper indicating band passes over the container threads and the container bead without interference, and as the cap is screwed onto the container, the ratchet teeth on said band contact and slide over the ratchet teeth on said container without generating sufficient frictional resistance to cause fracture of said webs snapping said skirt bead over said container bead;

and when said cap is unthreaded from said container, the ratchet means on said band and container cooperate to resist relative rotation therebetween, causing fracture of said frangible webs leaving said tamper indicating band on said container after said cap has been removed.

21. The screw-type safety cap according to claim 20 having eight equally spaced ratchet teeth extending around the inner periphery of said band which selectively engage four equally spaced ratchet teeth on said container.

22. The screw-type safety cap according to claim 20 wherein each of said ratchet teeth on said band have an inner face formed integral with the inner face of each of said plurality of axially extending frangible webs.

23. The screw-type safety cap according to claim 22 wherein each of said axially extending frangible webs is formed integral with and has its inner face in alignment with the inner surface of said second cylindrical skirt portion.

* * * * *